US005616009A

United States Patent [19]

Birdwell

[11] Patent Number: 5,616,009

[45] Date of Patent: Apr. 1, 1997

[54] MUD PUMP

[76] Inventor: J. C. Birdwell, 8535 Glencrest, Houston, Tex. 77061

[21] Appl. No.: 567,145

[22] Filed: Aug. 14, 1990

Related U.S. Application Data

[63] Continuation of Ser. No. 220,607, Jul. 18, 1988, abandoned, which is a continuation-in-part of Ser. No. 680,849, Dec. 12, 1984, abandoned, which is a continuation-in-part of Ser. No. 309,979, Oct. 8, 1981, abandoned.

[51] Int. Cl.[6] ..... F16J 10/04

[52] U.S. Cl. ..... 417/342; 417/347; 91/39

[58] Field of Search ..... 417/342, 347; 91/39

[56] References Cited

U.S. PATENT DOCUMENTS

| | | | |
|---|---|---|---|
| 3,022,738 | 2/1962 | Krute | 91/39 X |
| 3,080,821 | 3/1963 | Browne | 417/342 |
| 3,280,749 | 10/1966 | Sennet et al. | 417/342 |
| 3,295,451 | 1/1967 | Smith | 417/342 X |
| 3,733,965 | 5/1973 | Braun | 417/342 X |
| 4,500,267 | 2/1985 | Birdwell | 417/552 |

*Primary Examiner*—Richard E. Gluck

*Attorney, Agent, or Firm*—Nick A. Nichols, Jr.

[57] ABSTRACT

A multicylinder, double acting improved mud pump is disclosed. The preferred embodiment incorporates a hydraulic powered piston in a cylinder which connects with a piston rod which, in turn, drives a second piston in a cylinder adapted to pump fluid mud. The first piston is driven by hydraulic oil delivered under pressure to intake manifolds through an independently driven valving apparatus which times the delivery of the hydraulic fluid for the main power stroke and further times the discharge of the hydraulic fluid for the return secondary power stroke, the system being controlled independently of piston action in timing of multiple pistons in multiple cylinders by the valve system. Additionally an intake valve delivers fluid mud at lower pressure on the intake side of the mud compression piston, and an outlet valve transverses with the piston rod to direct the outlet mud flow. Additionally a mud piston is provided which defines a first compression chamber for receipt of incoming fluid mud and a second compression chamber for discharge of pressurized fluid mud. Additionally the outlet flow valve being contained within the confines of the mud piston and additionally the unidirectional flow valve being operatively controlled by the movement of the mud piston driving rod.

6 Claims, 5 Drawing Sheets

MUD PUMP

REFERENCE TO OTHER APPLICATIONS

This application is a continuation of Ser. No. 07/220,607, filed Jul. 18, 1988, now abandoned; which is a continuation in part of Ser. No. 06/680,849, filed Dec. 12, 1984, now abandoned; which is a continuation in part of Ser. No. 06/309,979, filed Oct. 8, 1981, now abandoned. Also this application contains subject matter in common with my now pending application Ser. No. 220,527, filed Dec. 29, 1980; Ser. No. 06/348,497 filed Feb. 11, 1982; Ser. No. 06/455,509 filed Jan. 4, 1983; and Ser. No. 06/529,487 filed Sep. 6, 1983. Attention is also directed to application Ser. No. 06/692,319, filed Jan. 16, 1985.

It is the object of the present application to present extended operational functions of the hydraulic circuitry disclosed in application Ser. No. 06/309,979; additionally to present additional hydraulic circuitry control methods associated with these extended operational functions.

BACKGROUND OF THE DISCLOSURE

The present apparatus is directed to a fluid mud pump and, more particularly, to a mud pump to be utilized to intensify fluid pressure for use in drilling oil wells or in conditioning oil wells such as fracturing with extremely high pressure or abrasive fluids. Various mud pumps and pressure intensification pumps are already known to exist that employ various and sundry means to overcome the difficulties encountered in prolonged pumping of high volume, high pressure, and abrasive materials. The present invention is an apparatus which will provide improvement in mud pumping operations in such areas as reduced mud pressure pulsation, less operating energy required for fluid pressure intensification, slower operating piston speeds and longer piston strokes thus resulting in extending life of all operating parts, wider range of mud flow and pressure controllability, greater simplicity of manufacture, improved adaptability and operation, plus other less apparent improvements. Thus the context of the problem to be dealt with in the present invention is that of a non pulsating output, highly efficient and controllable hydraulic powered fluid output pump.

DETAILED DESCRIPTION OF THE PREFERRED EMBODIMENT

Figure 1:
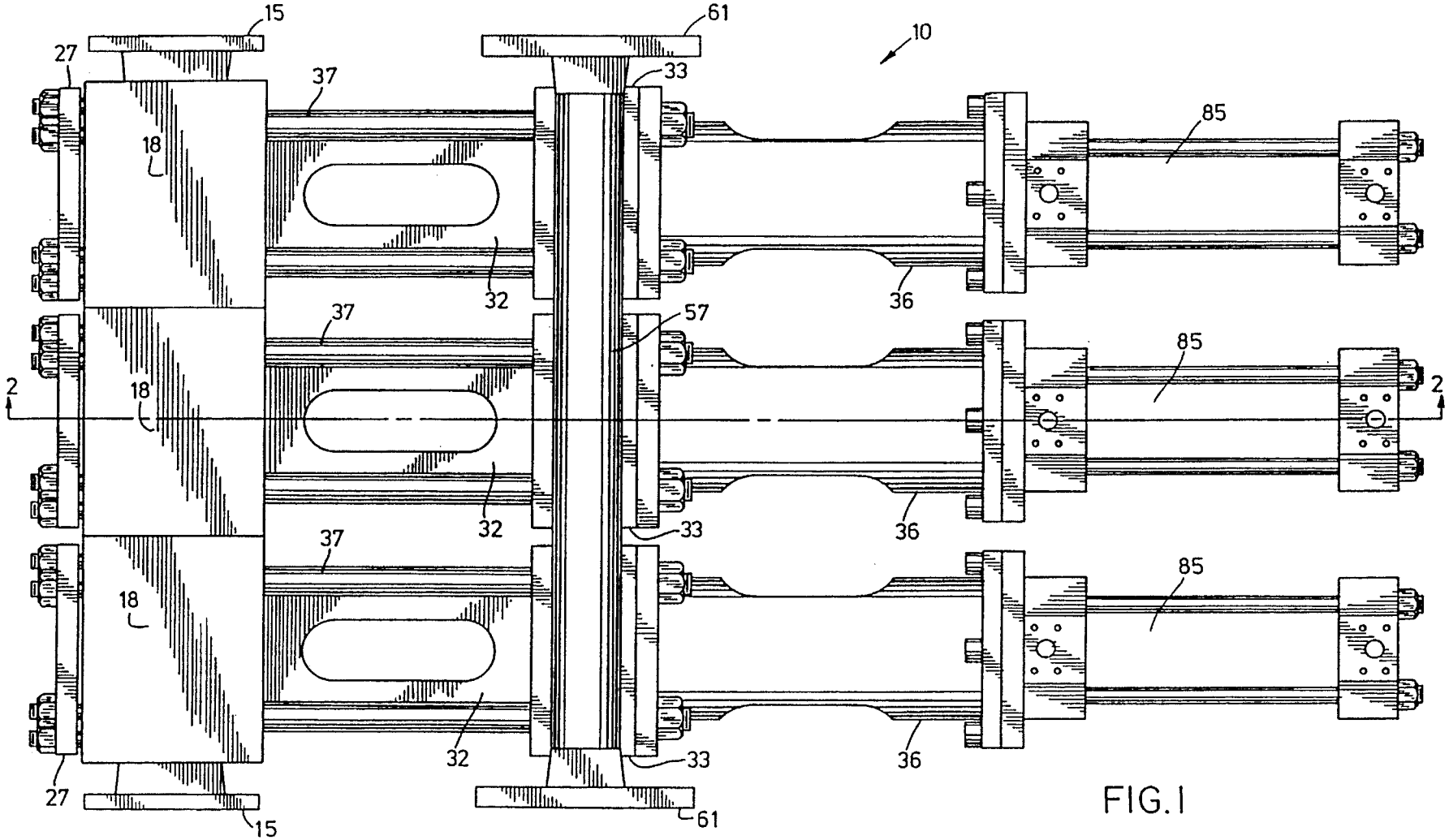
FIG. 1 is a plan view of multicylinder mud pump system in accordance with the teachings of the present invention.

Attention is first directed to FIG. 1 where the numeral 10 generally indentifies the pump according to the present invention. In this illustrated embodiment a plan view of a mud pump employing three pumping cylinders is shown. Three or more pumping cylinders is the preferred arrangement for this pump. Each pumping cylinder is the same in cross section and is connected to a common mud inlet manifold and to a common mud outlet manifold. Attention is also directed to FIG. 2 which is a section view taken along the lines 2—2 of FIG. 1. This section view is the same for each of the three pumping cylinders that comprise the mud pump of this invention.

Figure 2:
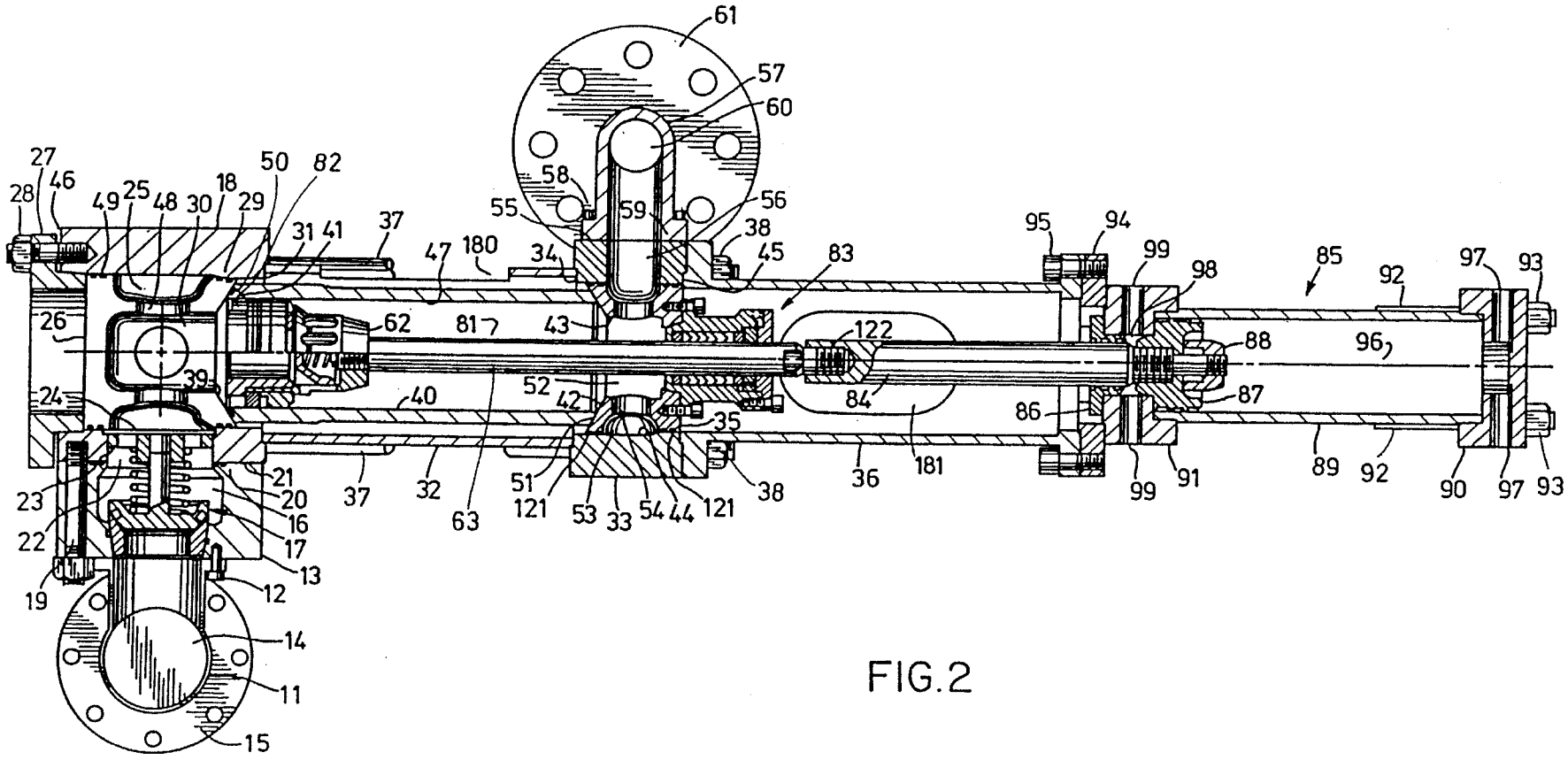
FIG. 2 is a section view taken along the line 2—2 of FIG. 1.

Referring specifically to FIG. 2, a suction manifold 11 is connected by bolts 12 to valve housing 13, manifold 11 connected to valve housing 13 of each pumping section and has an annulus 14 which is common to all valve inlets. Flange 15 is located on each end of manifold II to allow connection of annulus 14 to a suitable mud supply source. Valve housing 13 is a circular member with a circular bore 16 therethrough that is formed to receive unidirectional inlet valve assembly 17, valve assembly 17 consists of a valve seat, a spring loaded valve spool, and a compression spring element. Valve housing 13 is sealingly connected to a head flange 18 by bolts 19 and seals 20. Head flange 18 is elongated rounded member with a flat surface 21 on one side to receive member 13. The flat surface 21 has a rounded bore 22 extending inward which is concentric to and communicates with bore 16. Within bore 22 a circular shaped valve retainer plate 23 is positioned and held in place by snap ring 24 to retain unidirectional valve assembly 17 in position. Valve assembly 17 is positioned to allow relatively free fluid flow from annulus 14 to annulus 16 and to block fluid flow from bore 16 to annulus 14.

Head flange 18 contains a circular recess 31 on one end into which is fitted one end of a spacer tube 32, the second end of spacer tube 32 is likewise fitted into a circular recess 34 of one end of a head cap 33. An access opening 180 is provided through the side of member 32. Head cap 33 also contains a circular recess 35 on its second end into which is fitted a tubular shaped cylinder adaptor 36. An access opening 181 is provided through the side of adaptor 36. 18, 32, 33 and 36 are held together by tie rods 37 which are connected by threads to head flange 18 on one end and pass through headcap 33 and cylinder adaptor 36 on the second end. The second end of each tie rod 37 is threaded to receive a nut 38 which tightens against cylinder adaptor 36 to clamp together and retain flange 18, space tube 32, headcap 33, and adaptor 36 as a single unit with a concentric bore therethrough.

Head flange 18 contains a circular annulus 25 therethrough which communicates with annulus 22. Within annulus 25 an end cap 26 is slideably fitted and held in place by a circular retainer plate 27 and bolts 28. End cap 26 is an elongated circular member with a raised flange on each end that contains circular seals 29 on one end and circular seals 49 on the other end. Seals 29 and 49 form slideable sealing contact with the walls of annulus 25. The diameter of the flange that holds seals 29 is of a slightly reduced size than the diameter of the flange that holds seals 49, these seals also mate with correspondingly different sized diameters in annulus 24. These different sized sealing surfaces are to facilitate ease of assembly. End cap 26 also contains a recessed bore 30 on its inner face and side part 48 which communicates with annulus 25. The inner face of end cap 26 has a smooth, concentric circular tapered face 39 against which is fitted a correspondingly tapered face on the first end of a tubular shaped piston liner 40. The tapered face of the liner 40 contains a circular groove 41 into which a circumferential seal 50 is fitted to form a static seal between liner 40 and end cap 26. The second end of liner 40 contains a similar tapered face and sealing element 51 which mate with a corresponding tapered face 42 on an end seal member 43. Member 43 slidably and sealingly fits within a circular bore 44 of member 33. Member 43 is an elongated circular member with raised flanges on each end which each contain seals 121 fitted in circumferential grooves to form slidable seals within the bore 44 of member 33. Member 43 seats against a shoulder 45 of member 36 that limits its movement in one direction. Seal member 43, liner 40, and end cap 26 are pulled together by retainer plate 27. Retainer plate 27 being so positioned as to provide a space 46 that allows plate 27 to tighten against end cap 26 as bolts 28 are tightened. Liner 40 has a smooth inner bore 47 that is concentric with both tapered end faces. End cap 26 and its tapered bore 39 is positioned to be concentric with seal cap 43 and its tapered face 42. Thus as plate 27 is moved inward by tighting bolt 28, liner 40 will assume a concentric and sealed position with respect to end cap 26 and seal cap 42. Thus liner 40 can be of a wide range of bore diameters and maintain stable, concentric sealing contact with end cap 26 and seal cap 43. End cap 26 and seal cap 43 are positioned to maintain concentric positions through concentric alignment of annulus 25 and annulus 44.

End cap 43 has concentric bore 52 therethrough and a recessed groove 53 on its diameter which are in communication through part 54. Head cap 33 has a flat surface 55 on one side through which extends a port 56. Port 56 is in communication with groove 53. The flat surface 55 of head cap 33 is fitted to receive an outlet manifold 57 which is sealingly connected to number 33 by bolts 58 and circular seals 59. Manifold 57 connects to each of the three pumping cylinder assemblies and has a contained bore 60 therethrough which sealingly mates with bore 56 of each pumping cylinder to form an outlet annulus 60 that is common to each pumping cylinder. Manifold 57 is also fitted with flange 61 on each end for connection to a suitable outlet supply line.

Figure 9:
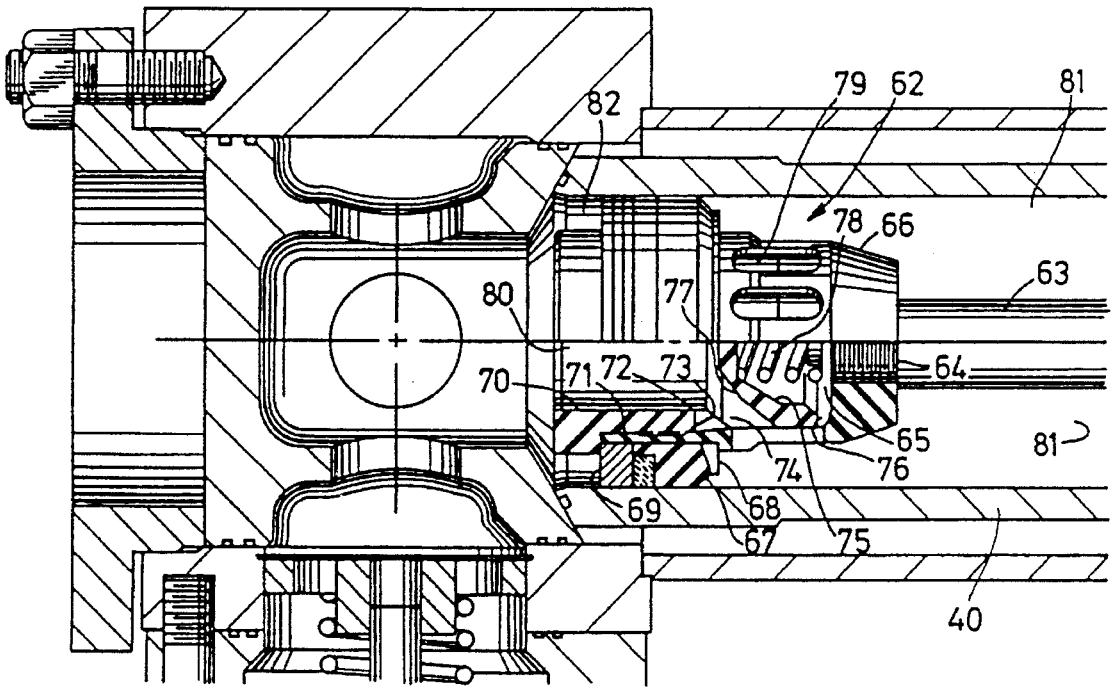
FIG. 9 is a view of the reciprocating mud piston and valve drawn to a larger scale than shown in FIG. 2.

Referring now to FIG. 9, liner 40 houses a member 62 which is a combination piston and unidirectional flow valve. Member 62 connects to piston rod 63 by threads 64 and is secured by snap ring 65. Member 62 consists of valve housing 66, piston seal 67, cap ring 68, piston backup ring 69, retainer cap 70, valve seat 72, seal 74, and valve plug 75. Member 66 is an elongated rounded member that is fitted on one end with a pliable sealing element 67. Element 67 is further positioned and held in place by a cap ring 68 and a backup ring 69, backup ring 69 being secured by a thread at 71. Retainer cap 70 further holds a valve seat 72 in place. Valve seat 72 is a circular ring type member with a smooth, hardened and tapered face 73 that houses a seal 74. Face 73 and seal 74 are fitted to receive a valve plug 75 that is slidably fitted into an annulus 76 of member 66. Valve plug 75 contains a smooth and hardened face 77 that is tapered to mate with face 73 and seal 74 to form a seal between member 75 and member 72. Member 75 is further fitted with a spring 78 that tends to exert a slight force against member 75 to position member 75 in normally sealed position against face 73, but which may be compressed to allow member 75 to assume a non-sealed position relative to face 73. Member 66 is fitted with slots 79 therethrough which are in communication with annulus 76. Member 70 has a bore 80 therethrough which becomes blocked when valve plug 75 is in a sealed position against face 73 but which is in communication with slots 79 when valve plug is not in a sealed position with face 73. When valve cap 75 is in a sealed position against face 73, then the annulus of liner 40 is separated into two distinct pressure chambers shown as a second pressure chamber 81 on the rod end of member 62 and as a first pressure chamber 82 on the back side of member 62. Unidirectional valve member 62 will open when pressure is applied from the first chamber 82 and allow flow from chamber 82 into chamber 81. Valve member 62 will close and hold pressure when flow attempts to travel from chamber 81 to chamber 82. Seal 67 is slidable within piston liner 40. Referring now to FIGS. 2 and 9, piston rod 63 extends forward from member 62, through a piston rod seal member 83 and connects by thread 122 to a cylinder rod 84. Cylinder rod 84 is the piston rod of a hydraulic cylinder assembly 85. Hydraulic cylinder assembly 85 consists of piston rod 84, piston rod seal 86, piston assembly 87, piston retainer cap 88, cylinder barrel 89, end cap 90, head cap 91, tie rod 92, and tie rod bolts 93. Tie rods 92 extend through end cap 90 and head cap 91 and are threadingly connected to an adapter flange 94. Adapter flange 94 is concentrically fitted to cylinder adapter 36 and retained in place by bolt 95. Thus as nuts 93 are tightened, piston cylinder 85 is secured and concentrically positioned with piston rod 63. Piston assembly 87 is fitted to slidably and sealingly form two pressure chambers within cylinder assembly 85; A rear chamber 96 with fluid inlet ports 97, and a front chamber 98 with fluid inlet ports 99. Thus as hydraulic fluid under pressure is directed to either chamber 96 or chamber 98, then piston 87 and piston rod 84 will respond with movement as directed by hydraulic fluid flow and pressure.

Figure 10:
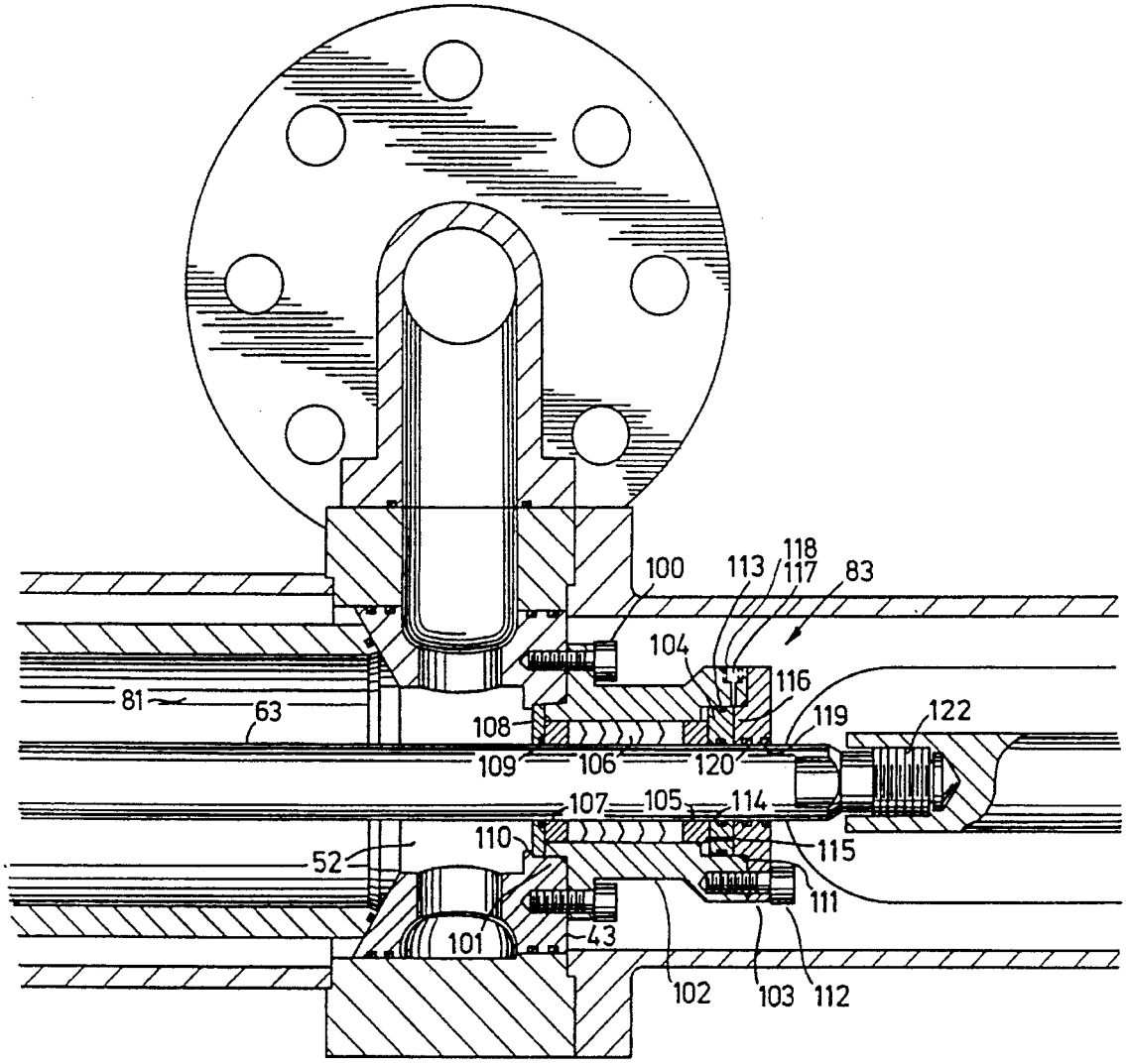
FIG. 10 is a view, drawn to a larger scale than shown in FIG. 2 of the mud piston rod seal that is shown in FIG. 2.

Attention is further directed to FIG. 10 which is an enlarged view of seal assembly 83. Assembly 83 is concentrically and sealingly fitted to end seal member 43 by bolts 100 and circumferential seal 101. Assembly 83 consists of a housing 102, end cap 103, slideable seal ring 104, seal end ring 105, seals rings 106, seal head ring 107 and retainer ring 108. Retainer ring 108 is a flat rounded ring that is centrally retained within member 43 by a shoulder 110 and member 102. Ring 108 positions in place a wiper ring 109 and retains member 107 from movement in a one direction. Housing member 102 is a rounded member with a bore therethrough into which is fitted seal head ring 107, seals 106, seal end ring 105, slidable seal ring 104, and end cap 103. End cap 103 is sealibly connected to member 102 by seal 111 and bolts 112, and is fitted to exert slight compression pressure on member 108, 107, 106, 105, and 104 as bolts 112 are tightened. Seal 106 is a rod seal which creates a slidable seal contact with piston rod 63 as compression pressure is exerted against the seal ends. Member 104 is a flat rounded plate with a slidable seal 113 on its outer circumference and a rod seal 114 on its inner circumference. Seal ring 104 also contains a small diameter orifice 115 which forms an annular communication with a recessed circumferential groove 116 that is formed in the face of member 103. Orifice 115 creates an annular communication between groove 116 and the surfaces surrounding member 105 and 106. Groove 116 further communicates with a small port 117 extending through the wall of member 102. Port 117 being threaded on the outer end at 118 to receive a suitable hydraulic connection for supply of pressurized hydraulic fluid. End cap 103 is a somewhat rounded member with a bore therethrough which is fitted with seals 119 and 120 to slidably seal against piston rod 63.

Thus as pressurized hydraulic fluid is supplied to connection 118, it will flow through port 117 to groove 116 where it will pressurize seal ring 104 thus exerting added pressure against seal 106. Pressurized fluid will further flow through orifice 115 and surround and lubricate seal 106. This process being continual with a minimum of leakage of hydraulic fluid across seal 106 as long as the pressure differential between groove 116 and pressure chamber 81 is held to a minimum. Seal 106 can be supplied with hydraulic fluid containing good lubricating characteristics and this supply of hydraulic fluid can be at a controlled pressure slightly higher than the mud pressure in chamber 81, thus seal 106 will effectively seal against mud leakage from chamber 81 as piston rod 63 reciprocates. Seal 106 will function with less friction and wear thus giving longer life and better sealing characteristics than if it were not lubricated by hydraulic fluid. The loss of hydraulic fluid will be held to a minimum due to the compression that is acting against seal 106.

Therefore, referring to FIGS. 10 and 2, as pressurized hydraulic fluid is supplied to Ports 99 and 97 of hydraulic cylinder 85, in such a manner to cause piston 87 to be powerly reciprocated, then piston rod 63 will cause piston assembly 62 to likewise reciprocate. As piston 62 moves toward the rod end or to decrease chamber 81, then valve plug 55 will assume a closed position and pressurized fluid will be forced out of chamber 81 through annulus 60 of outlet manifold 57. Simultaneously chamber 82 will create a vacuum due to the displacement of piston 62 and will pull in fluid from annulus 14 of inlet manifold 11. Incoming fluid will flow across inlet valve assembly 17, through annulus 16, 22, 25, through ports 48, and into chamber 82 to replace fluid that is being discharged from annulus 60. The amount of fluid drawn into chamber 82 will be greater than the amount displaced from chamber 81 by an amount equal to the volume associated with the piston rod 63.

Correspondingly as piston 62 moves away from the piston rod end or in the direction to decrease chamber 82, then the movement of member 62 will be in a direction to compress the entrapped fluid in chamber 82 and thus the fluid will flow through valve member 62 into chamber 81 and out annulus 60. When piston 62 moves in this direction the pressure in both chambers 82 and chambers 81 will be equal to the discharge pressure of annulus 60, and the fluid flowing from chamber 81 to annulus 60 will be equal to the volume of fluid displaced due to the volume of piston rod 63. Thus it is shown that as piston rod 63 continually reciprocates, fluid will be displaced from pressure chamber 81 to the discharge annulus 60 in both directions of travel of piston rod 63. Further, the pressure in chamber 81 and discharge annulus 60 will be equal in either directions of travel of piston rod 63.

Figure 3:
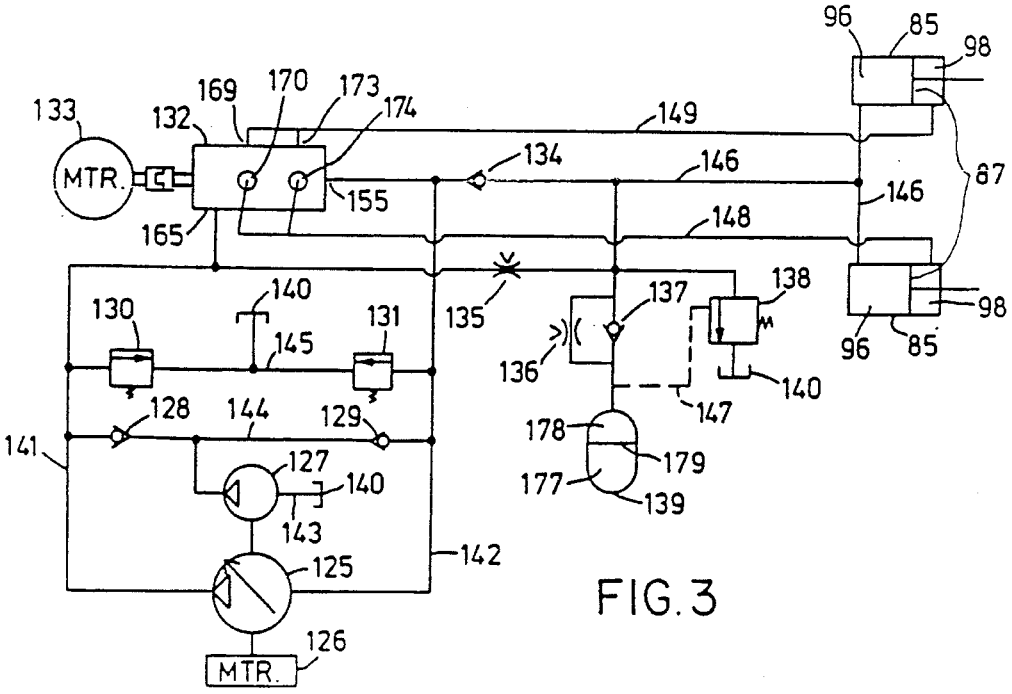
FIG. 3 is a schematic drawing showing a hydraulic system and power system used to power a typical mud pump of the present invention.

Attention is next directed to FIG. 3 which is a schematic drawing of a typical hydraulic circuit employed to power the hydraulic cylinders 85 of this mud pump. In this circuit only two cylinders 85 are illustrated for clarity of explanation, the addition of a third or more cylinders 85 will be explained later. The main components of this circuit are a main pump 125 that is driven by a prime motor 126, a charge pump 127 that is also driven by motor 126, one way check valves 128 and 129, high pressure relief valve 130, independently driven metering valve 132 that is independently driven by motor 133, one way check valve 134, flow control valve 135, flow control valve 136, one way check valve 137, relief valve 138, pneumatic type accumulator 139, hydraulic piston and cylinder combination 85, hydraulic reservoir 140, high pressure supply line 141, low pressure hydraulic return line 142, hydraulic flow lines 143, 144, 145, 146, 147, 148 and 149, and low pressure relief valve 131. The hydraulic system shown is a closed loop charged type hydraulic system employing a variable volume single direction, main pump. Most of the components in this hydraulic circuit and the usage thereof are well known by anyone versed in the art, so I will give detailed explanation only of unique and new pressurized fluid control means disclosed by this hydraulic circuit.

It will be noted that the hydraulic circuit shown in FIG. 3 is basically the same, except for some unique and new pressure control features, as has been prior disclosed in my patent application Ser. No. 06/133,948, Grp. Art unit 343, filed Mar. 25, 1980.

Figure 6:
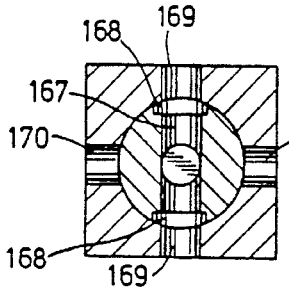
FIG. 6 is a section view taken along the lines 6—6 of FIG. 5.
Figure 7:
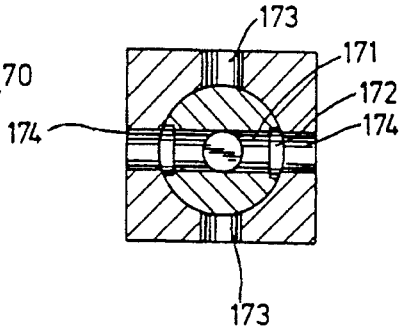
FIG. 7 is a section view taken along the lines 7—7 of FIG. 5.
Figure 4:
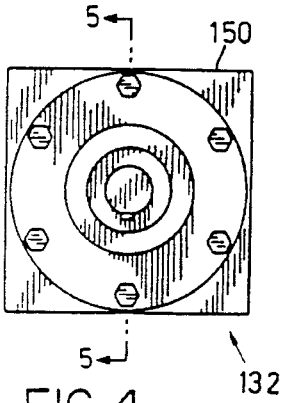
FIG. 4 is an end view of the independent driven metering valve that is used to distribute hydraulic fluid to the hydraulic drive cylinders of FIG. 3.
Figure 5:
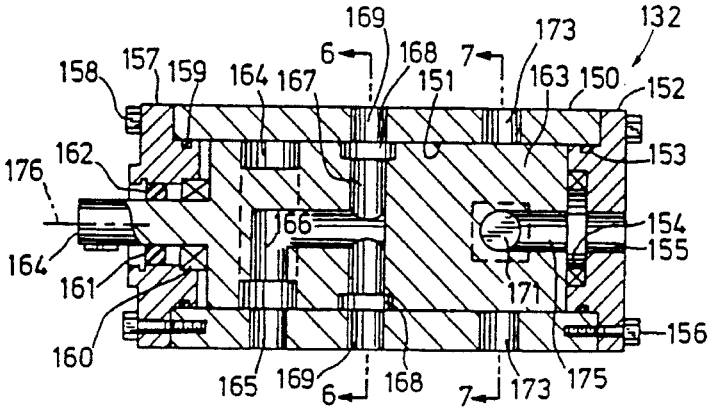
FIG. 5 is a section view taken along the line 5—5 of FIG. 4.
Figure 8:
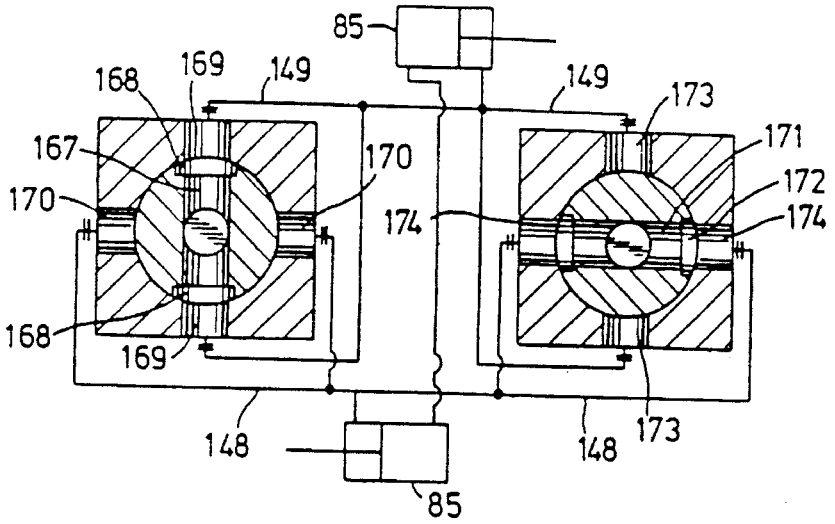
FIG. 8 is a schematic drawing showing hydraulic line interconnection between FIG. 6, FIG. 7, and the hydraulic drive cylinder of FIG. 3.

Attention is further directed to FIG. 4 which is an end view of metering valve 132. FIG. 5 is a section view taken along the line 5—5 of FIG. 4. FIG. 6 is a section view taken along the lines 6—6 of FIG. 5. FIG. 7 is a section view taken along lines 7—7 of FIG. 5. FIG. 8 is a schematic drawing imposed between FIG. 6 and FIG. 7 showing hydraulic line connections between FIG. 6, FIG. 7 and hydraulic cylinders 85. Referring to FIG. 5, valve 132 contains a housing 150 with a finely finished central bore 151 therethrough. Housing 150 has an end plate 152 on one end which retains in place a seal 153 for sealing against flows therebetween. End plate 152 also contains a thrust bearing 154 which is fitted into a recessed counterbore for containment, and a fluid return port 155 which passes therethrough and is fitted on its outer end for receipt of hydraulic fluid return line 142. End plate 152 is retained in place by bolts 156. On the other end housing 150 has a second end plate 157 which is retained in position by bolts 158 and which retains in place a seal 159. End plate 157 also contains a central bore therethrough into which is fitted a second thrust bearing 160 and a shaft seal 161. Seal 161 is retained in place by snap ring 162.

Mounted within bore 151 of housing 150 is a rounded rotatable valve spool 163 which is fitted to make rotatable sealing contact with the walls of bore 151. Spool 163 has a drive shaft 164 of reduced diameter extending from one end which extends through the bore of plate 157 and thus through seal 161 to form a drive connection means to rotate spool 163 about a rotational centerline 176 by an external rotary drive means. Contained within valve spool 163 is a groove 164 that circles the circumference and continually communicates with an inlet port 165 that is positioned in housing 150 and that is fitted to receive pressure line 141. Leading inward from groove 164 is a rounded annulus 166 which connects to an annulus 167. The centerline of annulus 167 passes through the rotational centerline of spool 163 and is perpendicular to the rotational centerline of spool 163 thus forming two equal annulus outlets from spool 163 which are at 180 degree spacing. The outer ends of annulus 167 is finely finished to form square like and equal recesses 168 into spool 163. Housing 150 contains a first bore 169 therethrough and a second bore 170 therethrough being positioned in line with bore 169 but at a 90 degree spacing to bore 169, both bore 169 and bore 170 being positioned perpendicular to the rotational centerline of spool 163. Bores 169 and 170 are positioned to alternately mate with annulus 167 of spool 163 as spool 163 rotates, thereby forming two alternating fluid outlet connections to annulus 167. Bore 169 is fitted on each end for hydraulic line connections to line 149. Bore 170 is fitted on each end for hydraulic line connection to line 148. Thus as spool 163 is rotated and pressurized hydraulic fluid is supplied to inlet port 165, it is equally and alternately distributed to ports 169 and 170. Further, it is distributed with no hydraulic pressure originated side loading being applied to spool 163 as the pressure outlets are directly opposed. Further a relatively large quantity of fluid can be distributed from spool 163 since it is being distributed simultaneously at two outlets.

Referring to FIGS. 5–8, valve spool 163 further contains a second annulus 171 the centerline of which passes through the rotational centerline of spool 163 and is perpendicular to the rotational centerline of spool 163. Annulus 171 is positioned at a 90 degree spacing relative to the centerline of annulus 167. The outer ends of annulus 171 are finely finished to form square line end equal recesses 172 into spool 163 and 180 degree spacing. Housing 150 contains a third bore 173 and a fourth bore 174, bore 173 being in the same plane as bore 174 but at a 90 degree spacing from bore 174. Both bore 173 and bore 174 are in a plane perpendicular to the rotational centerline of spool 163. Bore 173 is fitted at each end to receive hydraulic line connection from line 149. Bore 174 is fitted at each end to receive hydraulic line connection from line 148. Bores 173 and 174 are positioned to alternately mate with annulus 171 of spool 163 as spool 163 rotates thus forming two alternating fluid inlet connections to annulus 171. Spool 163 further contains a centrally located end port 175 which communicates with annulus 171 and continually communicates with fluid return port 155 in end plate 152. Bore 169 and bore 173 are positioned in the same longitudinal plane relative to rotational axis 176. Thus as spool 163 is rotated fluid return port 155 will equally and alternately be in communication with exhaust bores 173 and 174. Recess 168 and recess 172 can be sized to regulate the timing of fluid distribution as required.

Attention is directed to FIG. 8 and FIG. 5 where it is clearly shown that as spool 163 is rotated, pressure inlet port 165 of valve 150 is firstly in communication through line 149 with the pressure chamber on the rod end of a first cylinder 85 while simultaneously fluid return port 155 of valve 150 is first in communication through lines 148 with the pressure chamber on the rod end of a second cylinder 85. Secondly inlet port 165 is in communication through line 148 with the pressure chamber on the rod end of the second cylinder 85, while simultaneously fluid return port 155 of valve 150 is secondly in communication through line 149 with the pressure chamber on the rod end of the first cylinder 85. Thus as the spool 163 of valve 132 is rotated and pressurized fluid is applied to inlet port 165, then the pressure chamber of a one cylinder 85 can be supplied fluid to cause it to expand while the pressure chamber of a second cylinder 85 can exhaust the same amount of fluid through return port 155. It will be noted that a third cylinder 85 can be added to operate from valve 132 by addition of a third bore through housing 150 in the plane of FIG. 6 and in the plane of FIG. 7 and thusly positioning the three through bores at a 60 degree spacing relative to the rotational axis. The same would be true if any additional cylinders are used. For example, if a fourth cylinder 85, then four bores would be positioned at 45 degree, intervals about housing 150. However, to allow uninterrupted and continuously equal flow into inlet port 165 from outlet port 155 of valve 132, without allowing a substantial amount of fluid to bypass cylinders 85, three cylinders 85 must be used. Stated another way, three or more pressure chambers of equal displacement must be used unless fluid is to be added to the hydraulic fluid circuit. Thus, the pump of this invention will normally employ three or more cylinders 85, the fluid circuit depicted in FIG. 3 illustrating two cylinders 85 only for ease of explanation. Also in the circuit depicted in FIG. 3 outlet 169 and 173 are illustrated as emerging from one side only of valve 132 for ease of explanation, as are outlets 170 and 174. It is obvious that lines 149 and 148 could be so internally ported within housing 150 as to eliminate excessive outside piping.

Referring to FIG. 3, motor 126 powers charge pump 127 to precharge the hydraulic circuit to a pressure as determined by the setting of relief valve 131, preferably in the 200 P.S.I. range. Motor 126 also powers main pump 125 to supply pressurized fluid to line 141. Pressurized fluid travels through line 141 and enters valve 132 at port 165. Valve 132 being controllably rotated by motor 133; the rotation of valve 132 being independent of fluid flow or fluid pressure. Pressurized fluid is first directed to line 149 by valve 132 to pressurize chamber 98 of a first hydraulic cylinder 85 while chamber 98 of a second hydraulic 85 is vented by valve 132 to hydraulic return line 142 through outlet 155. Chambers 96 of cylinders 85 are connected by a common fluid line 146, thus as pressurized fluid enters chamber 98 of first cylinder 85 it will force fluid out of chamber 96 of said first cylinder end into chamber 96 of a second cylinder 85. The fluid entering chamber 96 of said second cylinder 85 will in turn force fluid from chamber 98 of said second cylinder, which fluid will be returned to line 142 through port 155 to be repressurized by pump 125. The amount of fluid returning to line 142 will be the same as is leaving from line 141, less leakage which is made up by charge pump 127. This process is alternately and continually repeated by cylinders 85 thus continually powerly stroking cylinder rods 84 of cylinder 85. The stroke length of cylinder rod 84 being determined by the amount of fluid passed through line 141, or by the rotational speed of valve 132. The pressure within hydraulic line 146 and thus within chamber 96 of cylinder 85 is controlled by relief valve 138. Thus fluid pressure is applied to chamber 98 of a first cylinder 85 to powerly drive piston rod 84. In a one retracting direction the secondary pressure created in chamber 96 can powerly drive piston rod 84 of a second cylinder in a second extending direction. Thus work can be performed simultaneously by all cylinders 85. When three cylinders 85 are used as will normally done according to the present invention, then the pressure chamber 98 of two cylinders 85 can simultaneous be receiving pressurized fluid while the chamber 98 of the third cylinder 85 is exhausting fluid. Conversely the pressure chamber 98 of one cylinder 85 can be receiving pressurized fluid while the chamber 98 of the second and third cylinder 85 are simultaneously exhausting fluid.

It will again be pointed out and stressed that valve 132 of this invention is an independently driven valve, which means that its rotation is completely independent from the movement of the piston 87 within cylinder 85. This independently driven control valve 132, to effectively control the movement of free floating pistons 87, is a new, innovative and advantageous concept of hydraulic powered cylinder control. The two major difficulties that have hindered development of high horsepower hydraulic driven reciprocating piston pumps in the past has been the seemingly impossible solution of supplying a large quantity of non-pulsating pressurized fluid to the cylinders while controlling the timing of each of the cylinder strokes.

Referring again to the hydraulic circuit of FIG. 3 it will be pointed out tha for the circuit to be operable piston 87 of cylinder 85 must be in a position to move when pressurized fluid is admitted to chamber 98. Stated another way, since piston 87 is not positively timed in relation to valve 132, then upon start-up of the pump according to the present invention if piston 87 is positioned at the expanded directional end of its stroke, and pressurized hydraulic fluid is directed to said expanded chamber, then damaging pressure pulsation will occur because the pressure will surge to the relief setting of high pressure relief valve 130. To assure that this situation does not normally arise, a variable volume pump 125 is employed as the fluid power source, and the pressurized driving fluid is directed to the rod end of cylinder 85. Note from the circuit of FIG. 3 that on start up or at any time that prime motors 126 and 133 are operating and hydraulic pump 125 is positioned in its neutral or no flow, position, the charge pump 131 will charge the complete system to the pressure as dictated by the low pressure 131 relief valve setting. This puts the same pressure on chambers 96 and 98 of cylinder 85, thus tending to expand chamber 96 due to the area of piston rod 84, thus piston 87 will always tend to position itself so that chamber 98 may expand and thus automatically assume a timed cycle relative to valve 132 as valve 132 rotates, without causing a high pressure surge. A low pressure source will occur which is determined by the relief valve setting of relief valve 138. Further, since pump 125 is a variable volume pump, the fluid going to cylinders 85 is gradually increased which correspondingly gradually increases the stroke length of piston 87 and allows piston 87 to automatically assume a timed relationship to valve 132 as piston 87 starts reciprocating. Further when the system is operating and the piston stroke length within cylinder 85, is decreased to zero by changing the output of pump 125 to zero, then the pistons 87 will automatically assume a near centered position relative to cylinder 85, thus providing for piston 87 to be in a position to expand and automatically assume a timed position with valve 132 as fluid is again supplied from pump 125.

Referring to FIGS. 2 and 3, indicated, the pump according to this invention is a double acting pump which means that cylinder rod 84 must supply force in each direction of travel. This force requirement depends upon the mud pressure being pumped and thus varies greatly. Therefore, the pressure requirements within pressure chamber 96 and thus line 146 varies considerably. The fluid reservoir created by chambers 96 and lines 146 will be of constant volume for a given cylinder stroke length and is in essence a closed reservoir. However, the reservoir of chambers 96 are subjected to sliding seals and to leakage so additional make up fluid must be continually supplied to this closed reservoir from a source of higher pressure. This is done by allowing a volume of fluid to continually flow from high pressure line 141 to line 146 through an adjustable metering valve 135.

Since there is no practical way to always supply the correct amount of make up fluid to the closed reservoir of chamber 96 and line 146, and since this reservoir must remain at or above the required volume, then an excessive amount of fluid must be allowed to flow across metering valve 135 and a suitable means must be provided to allow this excessive fluid to discharge from chamber 96 without causing excessive pressure surges. Note that the excessive fluid passed therethrough chamber 96 is also a means to provide cooling to chamber 96.

Piston 87 of cylinder 85 will automatically force fluid from chamber 96 across relief valve 138 as the piston strokes and chamber 96 will automatically assume the correct volume. However, there will be damaging pressure surges on the complete high pressure circuit unless valve 138 is set to dump fluid at a pressure only slightly above the pressure that is required in chamber 96. The required pressure in chamber 96 being that pressure that is necessary to move piston rod 84 against its load. Its load being varied as previously described. Thus relief valve 138 must be capable of sensing the loading requirement of chamber 96 and adjusting to allow fluid bypass therethrough at a pressure slightly higher that the load requirement, if this system is to function with a minimum of pressure surges. it will be noted that the pressure surge required to remove fluid from chamber 96 can be excessive, if not controlled, due to the larger piston area of piston 87 that it is acting against, and also due to the fact that the surge is sudden because the excess fluid will be discharged very suddenly when a one of pistons 87 has reached the end of its stroke. When piston 87 has reached the end of its stroke as described, than the pressure in chambers 96 will suddenly jump from whatever the required pressure to move piston rod 84, to whatever the relief valve 138 is set to relieve.

To overcome the above described conditions and maintain the said pressure surge to an acceptable and workable range, unique circuitry employing a gas operated accumulator 139 is used. Accumulator 139 contains a pressure chamber 177 filled with a compressible gas, a pressure chamber 178 for connection to hydraulic fluid, and moveable piston or diaphragm element 179 sealibly separating the two chambers. Chamber 177 is filled with a compressible gas and pressurized to approximately the same pressure as the charge relief valve 131. Chamber 178 is connected through check valve 137 and metering valve 136 to the closed reservoir formed by chamber 96 of cylinder 85. A line 147 connects the vent port of relief valve 138 to hydraulic chamber 178. As anyone versed in the art of hydraulics is aware, the vent port of a relief valve 138 can be utilized to control the pressure at which the relief valve 138 allows fluid to pass therethrough. Fluid will pass across said relief valve at a pressure equal, or just above the pressure at which fluid is allowed to pass from the vent port because of a spring loaded plunger positioned within the valve 138. I will not describe the internal operations or relief valve 138 as this is well known in the art. Chamber 178 of accumulator 139 is connected to chamber 96 of cylinder 85 through a one way check valve 137 that allows fluid from chamber 178 to flow to chamber 96, but blocks flow in the opposite direction. Chamber 178 is also connected to chamber 96 through a variable volume metering valve 136. Thus when pump 125 is supplying pressurized fluid to lines 141, then the pressure chamber formed by chamber 96 will be continually maintained at a pressure required to cause piston rod 84 to move against its load through metered pressurized flow across valve 135. The pressure in chamber 178 of accumulator 139 will also be equal to or slightly above the required pressure of chamber 96 because of valve 137 and valve 136. If chambers 96 contain an excessive amount of fluid then as a one piston 87 of cylinder 85 reaches the end of its stroke in the rod end direction, then the pressure in chamber 96 will start to rise. The rise in pressure will cause fluid to flow from the vent port of relief valve 138 to chamber 178 of accumulator 139 and thus allow relief valve 138 to pass fluid therethrough to low pressure line 142 thus allowing the excessive fluid to be dumped from chamber 96 at a pressure just higher than the required pressure in chamber 96. Chamber 178 will assume the pressure of chamber 96 through valve 137 and valve 136. However, chamber 178 will not be subject to a sudden pressure surges due to blockage of fluid flow at valve 137 and a metering of fluid at valve 136. Fluid vented from valve 138 is also internally metered within valve 138. Thus due to the compressibility of the gas in chamber 177, the fluid pressure in chamber 178 will rise at a slower rate that the pressure in chamber 96, thus allowing valve 138 to dump excess fluid from chamber 96. This process is continually repeated, thus keeping the fluid volume and pressure requirement of chamber 96 as necessary to continually operate cylinder rod 84 in a powerly reciprocating manner.

Thus it is noted that as a quantity of pressurized fluid is supplied to valve 132 by pump 141, and valve 132 distributes this fluid to chamber 98 of cylinder 85, then piston 87 will assume a stroke that is synchronized with the rotation of valve spool 163. This synchronization will occur pulse free as long as chamber 98 is free to expand and piston rod 84 has equal loading, and the correct pressure is maintained in chambers 96. The pressurized fluid within chamber 96 assures that piston 87 either assumes a somewhat centralized position or a rod end position within cylinder 85 whenever the fluid flow to cylinders 98 is decreased thus decreasing the stroke. Thus piston 87 will always assume a position to allow surge free synchronization with valve 132 and to allow surge free increase and decrease of its stroke length. The requirement for surge free synchronization between piston 87 and valve 132 being that the stroke length of piston 87 is reduced to a given amount prior to ceasation piston movement. On start-up of piston movement, the supply of pressurized fluid to chamber 98 be at a given minimum. The given minimum being dependent mainly upon the rotational speed of valve 132. However, a surge free synchronization can always be assured by bringing the pressurized fluid flow supply to valve 132 to a zero value at a reasonable reduction rate to cause piston 87 to cease stroking, while correspondingly increasing the pressurized fluid flow rate to valve 132 at a reasonable increase rate to commence stroking of pistons 87.

Thus it has been shown that independently operated valve 132 can receive, distribute, and return a large or a varying quantity of pressurized fluid without flow interruption or without damaging pressure side effects acting upon said valve. Further, free floating piston 87, and therefore cylinder rods 84 can be reciprocally and alternately powered in both directions of travel by large or varying quantities of pressurized fluid. Finally the piston stroke length of pistons 87 is controllable as desired; and piston stroke length can be started, stopped, or operated continuously without excessive pressure surges, and with an automatically assumed synchronization between the rotation of valve 132 and the stroke cycle of piston 87.

It has additionally been shown from the previous discussion that the loading upon each piston rod 84 will be equal when the above reciprocating piston system is employed to drive the pump of this invention. This equal loading of piston rod 84 being obvious from the disclosure that each piston of said mud pump discharges its flow directly into a pressure chamber common to all pistons of said mud pump.

Further unique operating characteristics of this pump are provided by the illustrated circuitry of FIG. 3 combined with the independently operated rotary valve 132. In the operation of the hydraulic drive system, there can actually be two distinct modes of operation—depending upon the start up relation between valve and cylinder. If the cylinders are all retracted completely, then the actual timing position between valve and piston can be slightly different from what it is if the pistons are positioned near mid range and free to move in each direction. The preferred mode of operation is with the pistons starting from a position not completely retracted. There are numerous means to assure that the pistons are in the preferred position at start up. It would normally occur when the circuitry is arranged as shown in FIG. 3 because valve 131 would normally be set at a low enough pressure so that frictional forces upon the cylinder piston rod would be enough to keep the piston of cylinder 85 in the "stopped" position unless drive pressure were applied to line 141. Another means that could be employed would be to remove check valve 134 and block line 146 at this position, then install a shut off valve on one side of valve 135 thus the pistons of cylinder 85 would be "locked" into the "stopping" position until the system is again started. It will also be noted that the line 145 leading from high pressure relief valve 130 can be connected to line 142 if desired to prevent a pressure drop in line 142 when fluid is by-passed across valve 130. It is also noted that the line leading from relief valve 138 can be connected to line 142 if desired instead of to reservoir 140 as illustrated to assist in prevention of a pressure drop in line 142.

It is additionally pointed out that the two modes of operation as discussed above actually encompass two different methods of the excess fluid being dumped from the interconnect chamber 96. In one case—the preferred case, the excess fluid is forced from the interconnected cylinder spaces as the valve relatively inhibits fluid flow from a cylinder 98 space; In the second case, when the system is started with the cylinders in the fully retracted position, the valve can assume a relative position where the excess fluid is dumped prior to the opening of a cylinder 98 space. The degree of change between the relative position of valve and piston is small; however, the degree of operational characteristics is large as the preferred case, the first case, allows a much broader range of cylinder piston speed and stroke length adjustment without system malfunction.

The pump of this invention has the capability to operate effectively at a large horsepower capacity. Oilfield pumps generally need to operate at a horsepower capacity of anywhere from 100 to 2000 horsepower. Thus when operating a hydraulic system of this type, it is an absolute requirement from a practical standpoint to have a system that does not experience sudden fluid flow blockage or does not experience a continued bypass of a large quantity of pressurized fluid. For example a 1000 horsepower system would require a fluid flow of approximately 500 gallons per minute at 3000 p.s.i. pressure. This represents a tremendous amount of energy and the machinery required to produce this energy cannot in actual application withstand shocks or heat that is generated from such practices as such that due to sudden flow stoppage to allow a valve to shift, or for a piston to move from a dead ended position, or for venting back to a holding tank a large quantity of pressurized fluid to control piston stroke length. For example, if half the above indicated fluid was vented to tank to cause a piston stroke length to change by one half, then it would require an additional 500 horsepower system to control the cooling of the vented fluid. To this end the pumping system that I have disclosed is an extremely versatile and controllable fluid pumping system that is relatively simple and can effectively and in a practical manner be continually operated to transmit a high horsepower capacity.

The foregoing is directed to the preferred embodiment but the scope of the present invention is determined by the claims which follows:

What is claimed is:

1. A reciprocating piston type hydraulic pump comprising:

(a) at least three drive cylinders, each of said drive cylinders being provided with a separate movable first piston disposed within it;

(b) a separate second movable piston disposed within a second cylinder, there being a second cylinder corresponding to said drive cylinder, wherein the number of second cylinders is equal to the number of drive cylinders;

(c) connector means extending between said first piston and said second piston within each of said pair of cylinders for integral movement of said first and second pistons;

(d) each of said first pistons dividing said drive cylinders to define a first chamber and a second chamber within each of said drive cylinders;

(e) means for connecting to each of said second chambers of said drive cylinders to form an expansionary fluid circuit containing pressurized fluid, said pressurized fluid flowing between said second chambers of said drive cylinders when said fluid is displaced from one or more of said second chambers by said first pistons;

(f) each of said first pistons displacing said pressurized fluid from its respective second chamber when said first piston is displaced in a drive direction;

(g) said pressurized fluid being periodically discharged from said expansionary fluid circuit;

(h) a source of pressurized drive fluid for connection to each of said first chambers of each of said cylinders;

(i) control valve means for connecting each of said first chambers to said source of pressurized drive fluid to displace each of said first pistons within its respective drive cylinder, said control valve means supplying drive fluid to each of said first pistons independently of piston position and movement within each of said drive cylinders, but in a timed and overlapping sequence;

(j) said control valve means also sequentially connecting said first chambers of said drive cylinders, which are not receiving said drive fluid from said control valve means, to exhaust lower pressure drive fluid;

(k) means to regulate the quantity of pressurized fluid within said expansionary fluid circuit to thereby timely increase or decrease the volume of fluid within said expansionary fluid circuit to enable operation during piston displacement changes wherein said means to regulate the quantity of pressurized fluid is responsive to pressure required to return the drive pistons;

(l) means to vary the stroke length of said first pistons within said drive cylinders;

(m) means to vary the volume of said expansionary fluid circuit to accommodate changes in the stroke length of said first pistons; and (n) wherein the volume of said expansionary fluid circuit decreases as stroke length of said first piston increase while not interrupting the sequential displacement of said first pistons within said drive cylinders.

2. The pump according to claim 1 including:

(a) means to monitor the pressure within said expansionary fluid circuit; and (b) means to remove pressurized fluid from said expansionary fluid circuit at a pressure relative to the monitored pressure within the expansionary fluid circuit.

3. The pump according to claim 2 including means to vary the frequency with which said control valve means supplies said pressurized drive fluid to said drive cylinders to vary the stroke length of said first piston within said drive cylinders.

4. The pump according to claim 3 including means to vary the volume of said drive fluid supplied from said drive fluid source to said drive cylinders to thereby vary the stroke length of said first piston within said drive cylinders.

5. The pump according to claim 1 wherein said valve means comprises a rotary valve with a rotatable fluid distribution spool within a spool housing, said spool housing having a plurality of spaced fluid ports, said distribution spool having a plurality of fluid channels for switchable fluid communication to fluid ports of said spool housing.

6. The pump according to claim 1 wherein said drive fluid source comprises a portion of a closed hydraulic loop which includes said control valve means and said first chambers of said drive cylinders, and wherein drive fluid is circulated through said closed hydraulic loop to maintain a predetermined fluid pressure within said loop.

* * * * *